US006806636B2

(12) United States Patent
Kang et al.

(10) Patent No.: US 6,806,636 B2
(45) Date of Patent: Oct. 19, 2004

(54) FLAT CRT WITH IMPROVED COATING

(75) Inventors: Cheon Su Kang, Taegu (KR); Sung Ho Park, Kumi (KR)

(73) Assignee: LG Electronics, Inc., Seoul (KR)

( * ) Notice: Subject to any disclaimer, the term of this patent is extended or adjusted under 35 U.S.C. 154(b) by 49 days.

(21) Appl. No.: 10/125,424

(22) Filed: Apr. 19, 2002

(65) Prior Publication Data

US 2003/0006692 A1 Jan. 9, 2003

(30) Foreign Application Priority Data

Jun. 15, 2001 (KR) ..... 2001-34029

(51) Int. Cl.[7] ..... H01J 29/88

(52) U.S. Cl. ..... 313/479; 313/422; 313/478; 313/477 R; 220/2.2; 220/2.1 R; 220/2.1 A

(58) Field of Search ..... 313/477 R, 422, 313/478, 479; 220/2.2, 2.1 R, 2.1 A

(56) References Cited

U.S. PATENT DOCUMENTS 5,455,063 A 10/1995 Jo
5,534,748 A * 7/1996 Oomen ..... 313/479
5,550,428 A 8/1996 Kume et al.
5,936,336 A * 8/1999 Shishido et al. ..... 313/402
6,555,953 B1 * 4/2003 Nishizawa et al. ..... 313/461
2002/0079807 A1 * 6/2002 Takahashi et al. ..... 313/402

FOREIGN PATENT DOCUMENTS

JP 279338 * 3/1990
JP 541179 * 2/1993

* cited by examiner

*Primary Examiner*—Ashok Patel
*Assistant Examiner*—Holly Harper
(74) *Attorney, Agent, or Firm*—Fleshner & Kim, LLP

(57) ABSTRACT

A CRT display including a display panel having a substantially flat outside surface, and an inside surface with a substantially fixed curvature includes a film coating with a non-uniform transmissivity. The film coating's transmissivity is varied, as a function of position, to compensate for variations in transmissivity exhibited by the display panel, thus resulting in substantially uniform image brightness across the surface of the CRT.

18 Claims, 6 Drawing Sheets

FLAT CRT WITH IMPROVED COATING

BACKGROUND OF THE INVENTION

1. Field of the Invention

The present invention relates to flat cathode ray tubes (hereafter "CRT"), and more particularly, to flat CRTs.

2. Background of the Related Art

CRT's are the most common type of display system used in homes, offices, and industrial sites. Modern CRT displays incorporate relatively flat and large sized display screens. Such flat and large CRTs are especially applicable to a multimedia environment in accordance with the development of display technologies and changes in consumer's tastes. As the variety of information media expands and uses of CRTs for displays increase, the demand for flat CRTs which minimize distortion of the displayed image increases.

In general, a CRT display is designed to have identical curvatures on both the inside and outside surfaces of the panel. The outside surface curvature causes a distortion of the displayed image. This distorted picture is difficult to view and the reflection of stray light at the panel surface causes glare which causes eye fatigue.

Since the glass surface of the display panel of a CRT is smooth, the glass surface can reflect external light causing unwanted glare. This glare from the display panel causes eyestrain and eye fatigue in the viewer, and also interferes with viewing the display panel and causes image degradation. Additionally, the CRT is formed of non-conductive glass, which allows a buildup of static electricity on the glass surface. To ameliorate the problems of glare and static charge buildup, in general, a silica base solution containing a conductive metal oxide, such as indium tin oxide (hereafter "ITO"), and a low reflectivity silica base solution are spin coated on the external surface of the display panel in succession, for not only reducing glare, but also for shielding static electricity and as an anti-reflection coating for electromagnetic waves. The anti-reflection properties are achieved through an offsetting effect of the two layers which causes reflected light to be cancelled through interference.

In the spin coating process, the display panel is fitted to a spin coater, and held in place by a vacuum pad, in which the display panel is affixed in place with vacuum by a vacuum chuck. Alternatively, the display panel can be held by a disk plate method, in which the display panel is fitted into a recess in a holding plate formed to receive the panel. After the panel is either fitted in the vacuum chuck or in the disk plate, it is spun within a chamber, while a coating liquid is dropped onto the display panel to form an anti-glare, anti-static and anti-reflective coating.

FIG. 1 is a schematic illustration of a related art method for spin coating a glass display panel, with the aforementioned solutions, by the disk plate method. In FIG. 1, the spin coater 10 includes rotating part having a fixed chamber 15, and a disk plate 25 fitted at the center of the chamber 15. The disk plate 25 is rotated by a motor 20. A coating solution feeder 30 over the disk plate 25 includes a pressurized coating solution tank 32, a connection tube 36 with a regulator 34, and a nozzle 38. The disk plate 25 has a recess formed to receive the display panel 5, and into which the display panel 5 is mounted. The rotational velocity of the disk plate 25 is controlled by a rotations per minute hereafter "RPM") controller (not shown) connected to the motor 20.

In operation, while the display panel 5 mounted on the disk plate 25 is rotated at a fixed RPM by the motor 20, the coating solution 40 flows from the pressurized coating solution tank 32 and is deposited onto the rotating display panel 5 through the nozzle 38. The amount of coating solution deposited on the display panel 5 is regulated by the regulator 34.

In order to reduce the problems exhibited by CRTs with curved surfaces, a panel having a flat outside surface has been developed. The panel with a flat outside surface (hereafter "FCD") is a structure which aids in forming a flat image by eliminating picture distortion at certain viewing distances and by accommodating different viewing positions to reduce viewer eye fatigue. However, the FCD is thinner near the center of the CRT display, and thicker near the edges specifically, the FCD has a thickness ratio from center to periphery of greater than approximately 170%. Due to the relatively large thickness ratio, the transmissivity of FCD, relative to the image forming light, varies between the center and the periphery of the CRT display panel.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Another object of the present invention is to provide a flat CRT with substantially improved viewability.

Another object of the present invention is to provide a flat CRT in which a thickness of an antireflection and/or antistatic coating on an outside surface of a display panel is varied as a function of location, not only for antireflection, antistatic, and electromagnetic shielding, but also for elimination of transmissivity variations that are caused by the increased thickness ratio that results as the panel is made flatter.

To achieve these and other advantages and in accordance with the purpose of the present invention, as embodied and broadly described, the flat CRT includes a display panel having a substantially flat outside surface, an inside surface with a fixed curvature, and a film coating on the outside surface of the display panel for antireflection and/or for reducing static electricity, wherein a display panel thickness ratio between the display panel edge and the display panel center is greater than approximately 170%. In addition to the film coating thickness being different between the panel's center and the panel's edge, the film coating thickness changes smoothly and gradually from the panel's center to the panel's edge.

The difference of film coating thickness preferably varies between the panel's center and the panel's edge part is approximately 10–35 nanometers (hereinafter "nm"), or approximately 15–30 nm. The film coating transmissivity, y, at different positions across the surface of the panel on the diagonal, long, and short axes can be expressed according to the following equations:

for the diagonal axis $A$: $0.8624x^2-2.0957x+73.71 \leqq y \leqq 0.8643x^2-2.0957x+76.72$, for the short axis $B$: $0.2571x^2-0.5229x+72.69 \leqq y \leqq 0.2571x^2-0.5229x+75.66$, for the long axis $C$: $0.5000x^2-1.0600x+72.99 \leqq y \leqq 0.5000x^2-1.0600x+75.96$, wherein x denotes a position on the diagonal, short or long axes.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Typical display panels of flat CRTs include a substantially flat outside surface, an inside surface with a prescribed curvature, and a thickness ratio of a panel edge to a panel center in a range of approximately 170%–230% between the two surfaces. Such typical CRT display panels have transmissivities which vary with panel cross-section thickness between the panel center and the panel edge. In other words, because the panel at the panel center is thinner than at the panel edge, the panel edge has a lower transmissivity than the panel center. On these typical CRT display panels, if a film coating applied to the display panel surface has uniform thickness across the display panel, the image rendered by the CRT will be brighter at the panel center where the transmissivity is high, and darker at the panel edge where the transmissivity is low. Such position based deviations in display panel transmissivity cause variations in the brightness of the image rendered by the CRT.

To improve the brightness uniformity of a CRT image, an embodiment of the present invention includes varying the thickness of the film coating on the display panel in accordance with the transmissivity of the panel across the surface of the panel. In other words, the panel center having a thinner cross-section has an accordingly thicker film coating, and the panel edge, having a thicker cross-section has an accordingly thinner film coating, to make a total transmissivity of the display panel uniform.

Figure 1:
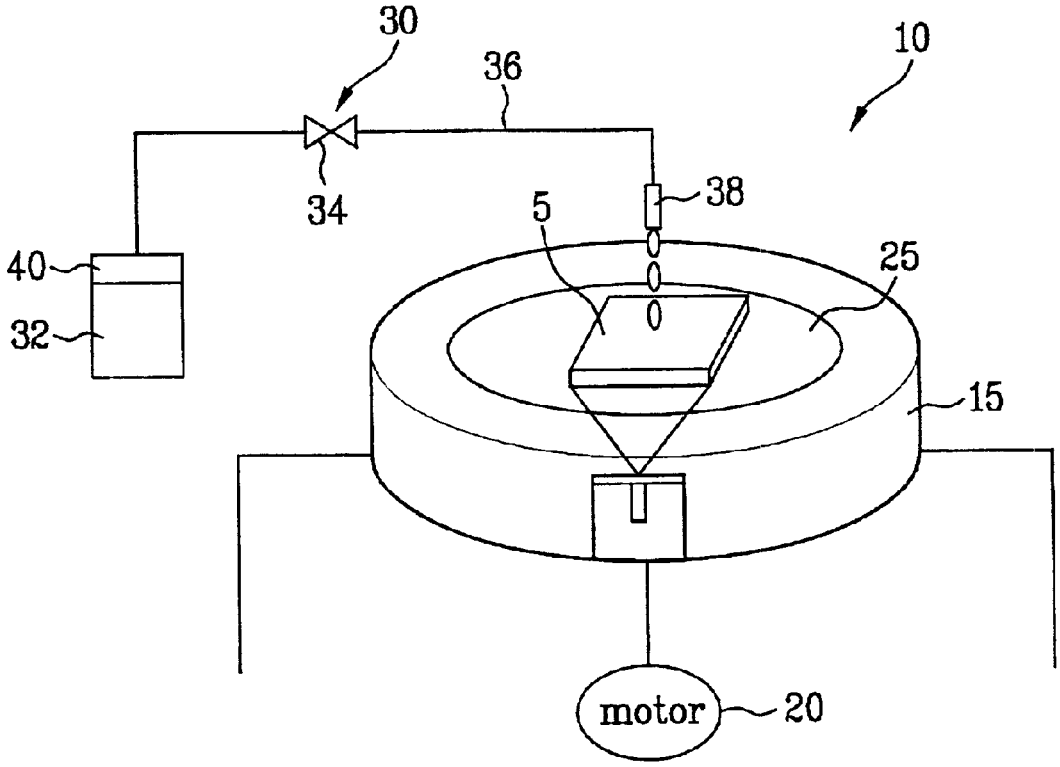
FIG.1 Related Art
FIG. 1 schematically illustrates a related art method for depositing a film coating solution on a CRT display panel.
Figure 2:
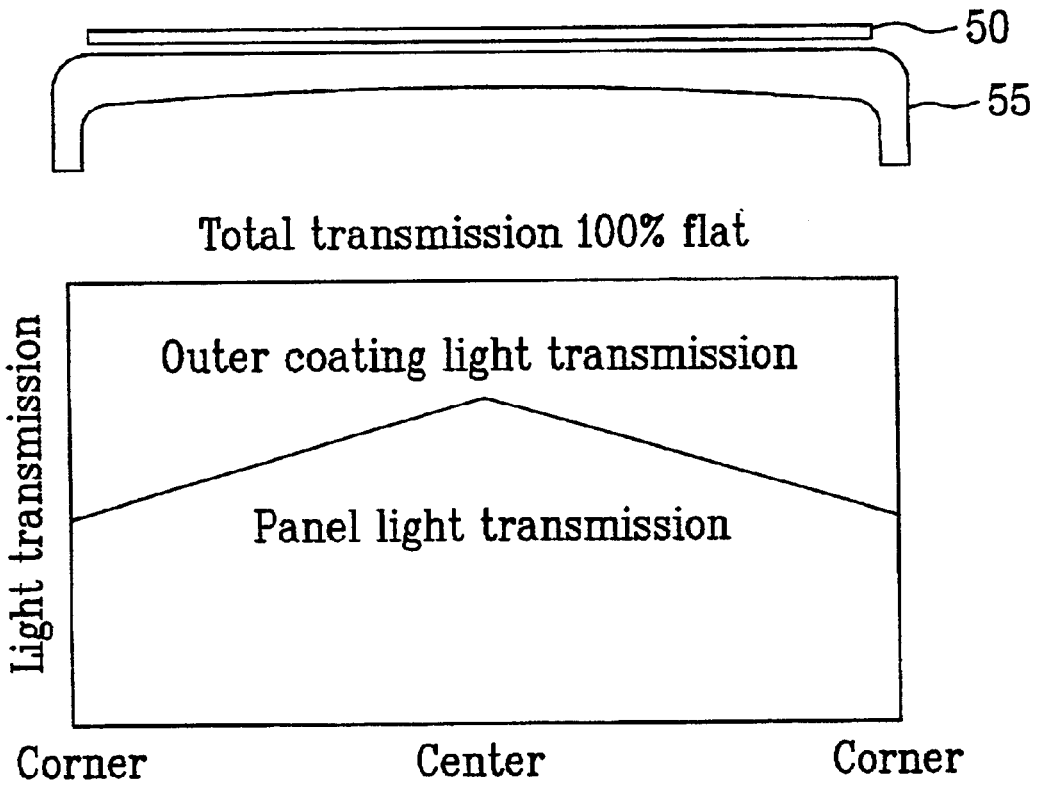
FIG. 2 illustrates a cross-sectional view of a flat CRT display panel with a film coating in accordance with one embodiment of the present invention, along with a graph showing panel transmissivity, film coating transmissivity and total transmissivity.

FIG. 2 illustrates a cross-section of a panel display incorporating an embodiment of the present invention, with a graded transmission film coating 50, and a low clear glass panel 55. FIG. 2 also illustrates a graph of a total transmissivity of a display panel incorporating the embodiment of the present invention. The graph shown in FIG. 2 also separately shows the transmissivity of the film coating 50, and the transmissivity of the glass panel 55 of the present invention.

Figure 3:
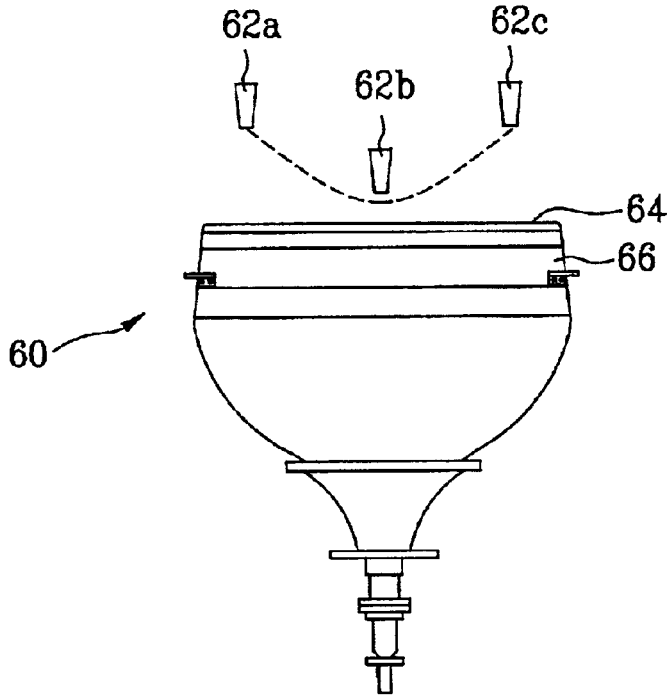
FIG. 3 illustrates a method for applying a film coating on a display panel in accordance with one embodiment of the present invention.

The related art spin coating methods can not create a film coating with different thicknesses between the panel center and the panel edge. As illustrated in FIG. 3, instead of spin coating, an embodiment of the present invention employs a spray nozzle. Also, instead of rotating the display panel 66, the display panel 66 is made to move from side to side while the distance between the spray nozzle and the display panel 66 is varied in a prescribed manner for variably controlling the thickness of the film coating 64.

Referring to FIG. 3, three positions 62*a*, 62*b*, and 62*c* of the spray nozzle are shown set at different heights at the panel centers and the panel edge for controlling a thickness of a film coating 64. That is, the nozzle is set farther from the display panel 66 when the film coating 64 is applied to the panel edge, and the nozzle is set closer to the display panel 66 when the film coating 64 is applied to the center part. Such a configuration allows for applying a thinner film coating 64 at the panel edge and a thicker film coating 64 at the panel center. The film coating 64 is applied to the display panel 66 of the CRT 60.

One embodiment of the present invention includes the thickness of the film coating 64 being designed differently according to CRT transmissivity. A high transmissivity of the panel 66 provides a good luminance, but too high a luminance causes poor contrast. To improve contrast, a display panel 66 having a coating of black filter film on an inside surface is preferably used in an embodiment of the invention, for reducing the transmissivity and thereby improving image contrast. In general, a display panel 66 with a coating of the black filter film has a transmissivity approximately 14% lower than a panel 66 without the black filter film. This results in a reduction of the total transmissivity of the panel 66 and the film coating 64 by approximately 14%.

Figure 4:
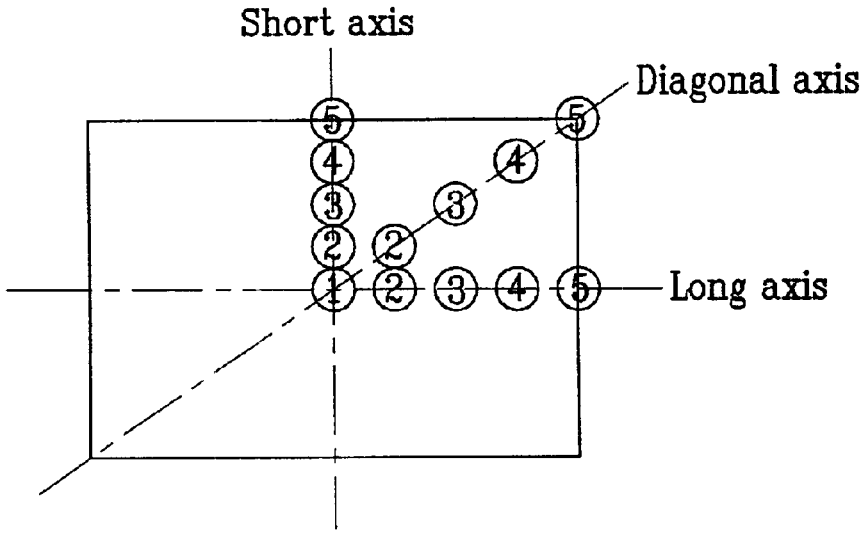
FIG. 4 illustrates how a display panel is divided into quadrants along three different axes for determining a thickness of the film coating, in accordance with the present invention.

An embodiment of the present invention includes varying a thickness of the film coating 64 in accordance with different positions of the panel 66. Thus, as shown in FIG. 4, a thickness of the film coating 64 is controlled in accordance with a position of the spray nozzle, as the spray nozzle is moved in a quadrant in the three directions of the long, short, and diagonal axes directions. The nozzle height is set in accordance with steps across the surface of the display panel 66 equivalent to ¼ of the distance from the center of the panel 66 to the edge of the panel 66. The position of the spray nozzle is incremented by ¼ as shown in FIG. 4. The resulting film coating transmissivity, y, can be expressed as follows for each respective axis and position:

for the diagonal axis *A:* $0.8624x^2-2.0957x+73.71 \leqq y \leqq 0.8643x^2-2.0957x+76.72$, for the short axis *B:* $0.2571x^2-0.5229x+72.69 \leqq y \leqq 0.2571x^2-0.5229x+75.66$, for the long axis *C:* $0.5000x^2-1.0600x+72.99 \leqq y \leqq 0.5000x^2-1.0600x+75.96$, wherein x denotes an integer ranging from 1–5, indicating a position on the short, long, or diagonal axis.

The film coating 64 of an embodiment of the present invention applied to the display panel 66, according to the foregoing method has an even thickness within each of the zones throughout the entire panel 66. When the panel 66 is divided into four zones, starting from a center and going to the outer most edge of the panel in the long, short, and diagonal directions, the thickness of the film coating 64 varies by less than 25 nm between each of the four zones.

FIG. 4 also illustrates measuring a transmissivity of a film coating 64 at different positions of the panel 66 incorporating an embodiment of the present invention. The transmissivity may be measured at 45 mm increments along the x-axis, and 34 mm increments along the y-axis, with respect to the center of the panel, at 5 points in each direction.

Figure 5A:
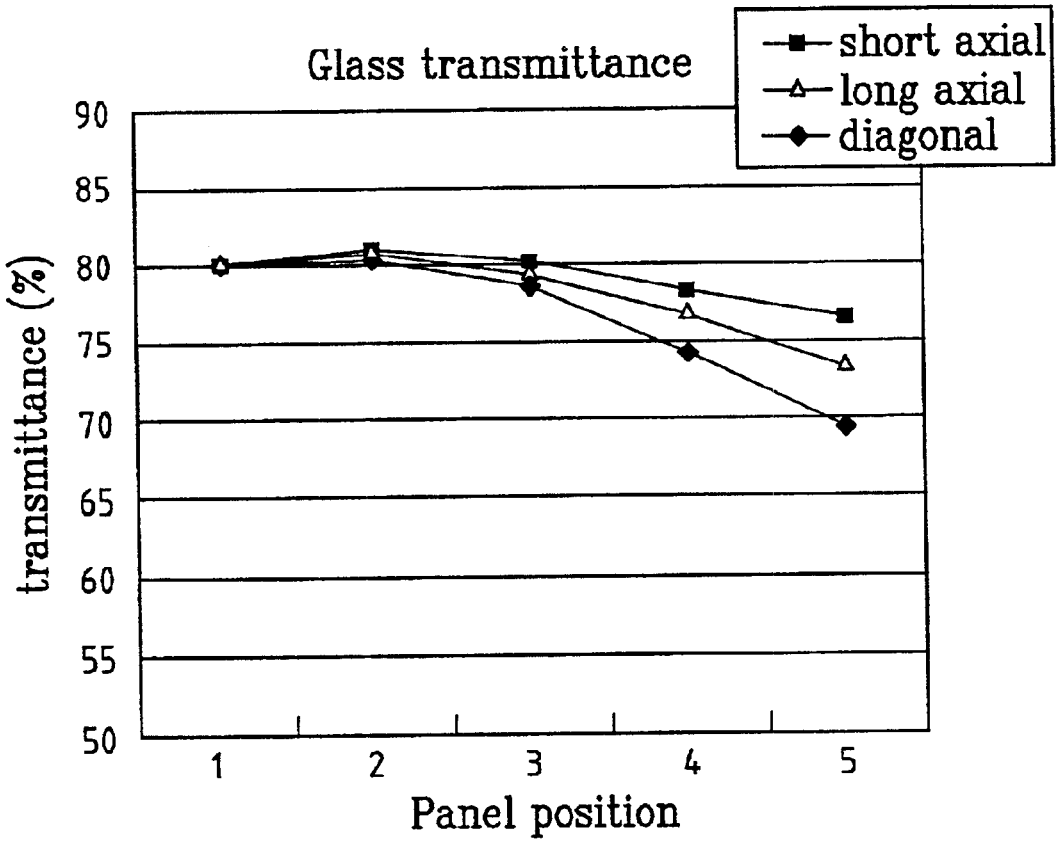
FIG. 5A illustrates a transmissivity of a display panel as a function of position, in accordance with the present invention.
Figure 5B:
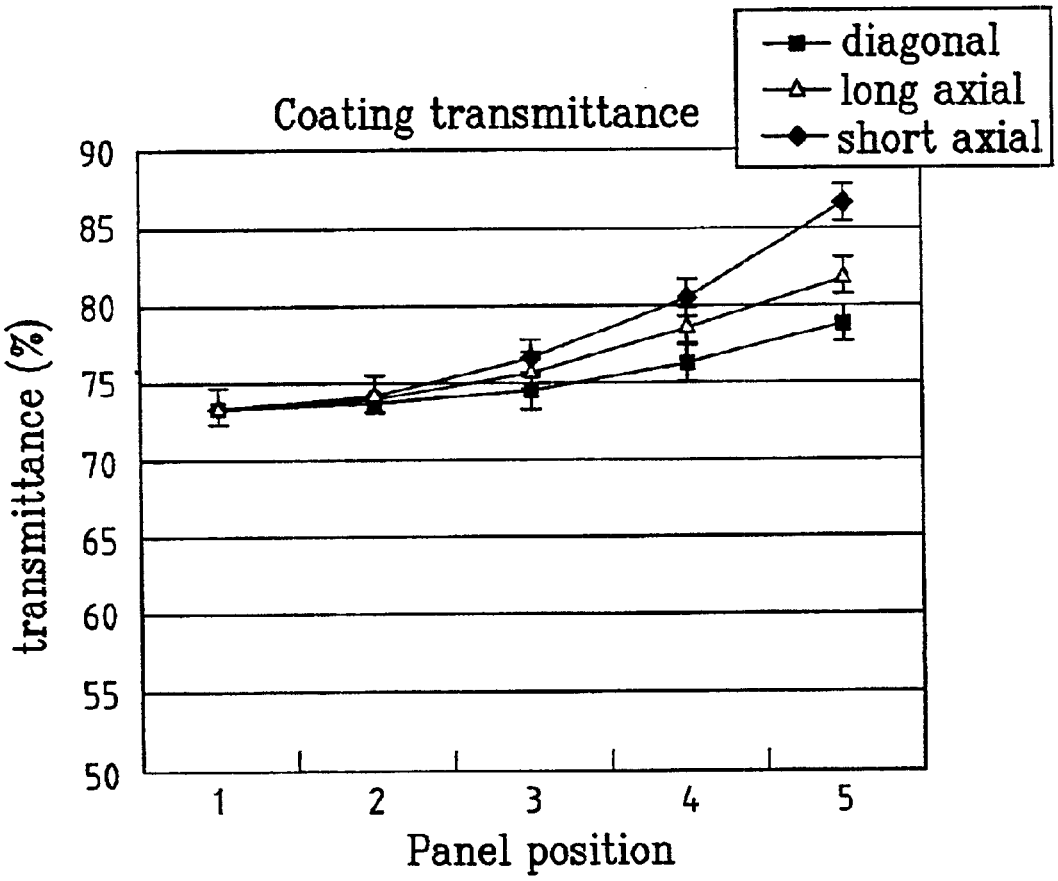
FIG. 5B illustrates a transmissivity of a film coating as a function of position, in accordance with of the present invention; and, FIG. 5C illustrates a transmissivity of a film coating as a function of position, in accordance with a preferred embodiment of the present invention.

Table 1 below shows the transmissivity percentages of the display panel without the film coating 64 at different positions, and Table 2 below shows the transmissivity percentage of the film coating 64 at different positions of the display panel 66. FIGS. 5A–5B illustrate graphs from corresponding to Tables 1 and 2, respectively.

TABLE 1

| Position | Diagonal | Short axis | Long axis |
|---|---|---|---|
| 1 (center) | 80.1 | 80.1 | 80.1 |
| 2 | 80.3 | 80.8 | 80.6 |
| 3 | 78.3 | 80.1 | 79.1 |
| 4 | 74.4 | 78.7 | 76.7 |
| 5 | 69.9 | 76.9 | 73.4 |

TABLE 2

| Position | Diagonal | Short axis | Long axis |
|---|---|---|---|
| 1 (center) | 73.9 | 73.9 | 73.9 |
| 2 | 74.7 | 73.9 | 74.4 |
| 3 | 76.6 | 74.2 | 75.8 |
| 4 | 80.6 | 76.2 | 78.2 |
| 5 | 86.6 | 78.0 | 81.7 |

As indicated by Tables 1 and 2, and FIGS. 5A, and 5B, the transmissivity of the panel 66 decreases towards the panel's edge, and the transmissivity of the film coating 64 increases towards the panel's edge. A sum of the panel-only transmissivity and the film-coating-only transmissivity is substantially constant at all positions across the surface of the panel 66, and allows the CRT to tender a uniform brightness throughout the display panel 66 when the screen is viewed from various positions.

In a second embodiment of the present invention, the film coating 64 is deposited on a display panel 66 having no black coating film on an inside surface of the panel 66. In this embodiment, the transmissivity of the applied film coating 64 is lower than the transmissivity of the typical film coating applied to a panel with the black film coating. The transmissivity, y, in the diagonal, short, or long axis directions are set according to the following equations:

for the diagonal axis, $A$: $0.8643x^2-2.0957x+59.71 \leqq y \leqq 0.8643x^2-2.0957x+62.72$, for the short axis, $B$: $0.2571x^2-0.5229x+58.69 \leqq y \leqq 0.2571x^2-0.5229x+61.66$, for the long axis, $C$: $0.5000x^2-1.0600x+58.99 \leqq y \leqq 0.5000x^2-1.0600x+61.96$, wherein, and x denotes an integer ranging from 1–5, indicating a position on the short, long, or diagonal axis.

Figure 5C:
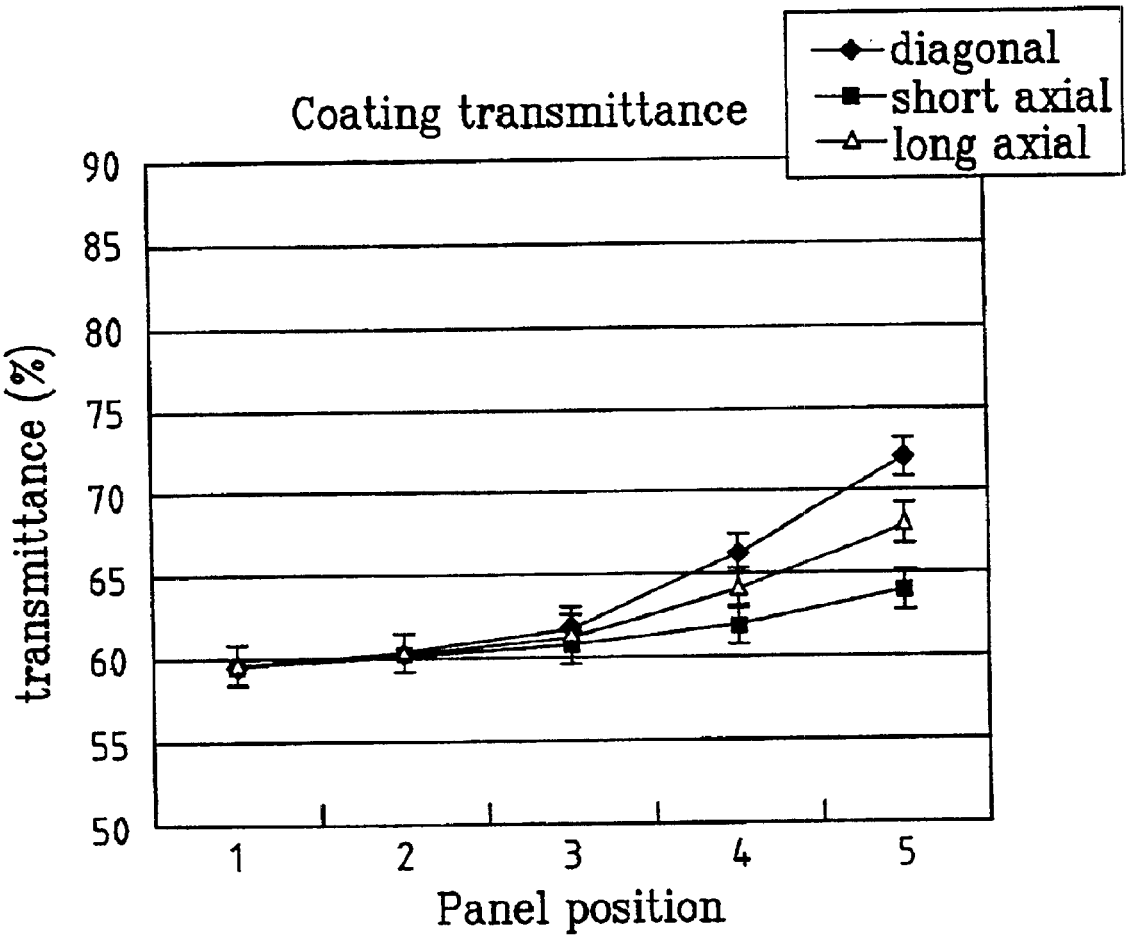

Table 3 and FIG. 5C shows the transmissivity percentage of the film coating 64 at different positions, in accordance with an embodiment of the present invention.

TABLE 3

[unit: %]

| Position | Diagonal | Short axis | Long axis |
|---|---|---|---|
| 1 (center) | 59.9 | 59.9 | 59.9 |
| 2 | 60.7 | 60.2 | 60.4 |
| 3 | 62.6 | 62.9 | 61.8 |
| 4 | 66.6 | 62.2 | 64.2 |
| 5 | 72.4 | 64.0 | 67.7 |

In this example, the transmissivity of the film coating 64 increases closer to the panel's edge and sum of the display-panel-only transmissivity and the film-coating-only transmissivity is approximately constant at all positions of the panel. Thus, the CRT display brightness is substantially uniform across the surface of the screen.

For achieving similar luminance uniformity, related art display panels vary the the thickness of fluorescent material coated on an inside surface of the display panel, or the thickness of the electron beam aperture in the shadow mask, so that, at the panel's edge, the thickness of the fluorescent material or electron beam aperture is greater than at the panel's center by approximately 115–120%. Such an increase in thickness causes poor purity at the panel's edge. However, the present invention allows the thickness of the fluorescent material, or the thickness of the electron beam aperture in the shadow mask, at the panel's edge to be less than 115%, and preferably less than 110%, of the thickness at the panel's center, thereby obtaining uniform brightness across the screen while preventing deterioration of the purity.

As previously indicated, in a flat CRT having a display panel with a substantially flat outside surface and an inside surface with a fixed curvature, an embodiment of the present invention reduces brightness variations caused by variations in the thickness of the display panel between the panel's center and the panel's edge. Such brightness variations can not be overcome by the spin method of display panel coating. An embodiment of the invention ensures a uniform image brightness across the surface of the screen, while providing antireflection, antistatic electricity, and electromagnetic shielding properties to the CRT display.

Moreover, purity deterioration, caused by increased thickness of the fluorescent material, or increased thickness of the electron beam aperture in the shadow mask, at the panel edge than of the panel center, can be reduced.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A flat cathode ray tube (CRT), comprising:

a panel having a substantially flat outside surface, and an inside surface with a substantially fixed curvature;

a black filter film coated on the inside surface of the panel configured to improve contrast and, a film coating on the outside surface of the panel configured to reduce reflections or antireflection static electricity, wherein a panel thickness ratio of a panel edge to a panel center is greater than approximately 170% and a transmissivity y of the panel film coating at adifferent positions on a diagonal axis A, a short axis B, and a long axis C, of the panel is expressed according to:

for the diagonal axis, $A$: $0.8624x^2-2.0957x+73.71 \leqq y \leqq 0.8643x^2-2.0957x+76.72$, for the short axis, $B$: $0.2571x^2-0.5229x+72.69 \leqq y \leqq 0.2571x^2-0.5229x+75.66$, for the long axis, $C$: $0.5000x^2-1.0600x+72.99 \leqq y \leqq 0.5000x^2-1.0600x+75.96$, wherein x denotes an integer ranging from 1–3, indicating a position on the short, long, or diagonal axis.

2. A flat CRT as claimed in claim 1, wherein the panel thickness ratio of the panel edge to the panel center is in the range of 200%–230%.

3. A flat CRT as claimed in claim 1, wherein a difference of film coating thickness between the center part and the panel edge approximately ranges from 10 to 35 nm.

4. A fiat CRT as claimed in claim 1, wherein a difference of film coating thickness between the panel center and the panel edge approximately ranges from 15 to 30 nm.

5. A flat CRT as claimed in claim 1, wherein a difference of film coating thickness between zones is approximately 25 nm, the zones being four divisions of the panel starting from the panel center to the panel edge in the long, short, and diagonal directions.

6. A flat CRT as claimed in claim 1, wherein a thickness of a fluorescent material coated on an inside surface of the panel or a thickness of an electron burn pass-through hole in a shadow mask, of the panel edge is less than 115% of a corresponding thickness at the panel center.

7. A flat cathode ray (CRT), comprising:

a panel having a substantially flat outside surface, and an inside surface with a substantially fixed curvature; and, a film coating coated on the outside surface of the panel far antireflection and/or antistatic electricity, wherein transmissivity y of the film coating at different positions on diagonal axis A, a short axis B, and a long axis C is expressed according to the following equations:

for the diagonal axis, $A$: $0.8643x^2-2.0957x+59.71 \leqq y \leqq 0.8643x^2-2.0957x+62.72$, for the short axis, $B$: $0.2571x^2-0.5229x+58.69 \leqq y \leqq 0.2571x^2-0.5229x+61.66$, for the long axis, $C$: $0.5000x\ 2-1.0600x+58.99 \leqq y \leqq 0.5000x^2-1.0600x+61.96$, and x denotes an integer ranging from 1–5, indicating a position on the short, long, or diagonal axis.

8. A flat CRT as claimed in claim 7, wherein a panel thickness ratio of a periphery part of the panel to a center part of the panel is in the range of 200%–230%.

9. A flat CRT as claimed in claim 7, wherein a difference of film coating thickness between a center part of the panel and the periphery part of the panel approximately ranges from 10 to 35 nm.

10. A flat CRT as claimed in claim 7, wherein a difference of film coating thickness between a center part of the panel and a periphery part of the panel approximately ranges from 1.5 to 30 nm.

11. A flat CRT as claimed in claim 7, wherein a difference of film costing thickness between zones is approximately 25 nm, the quadrants being four divisions of the panel starting from a panel center to a panel edge in the long, short, fluid diagonal directions.

12. A flat CRT as claimed in claim 7, wherein a thickness oft fluorescent material coated on an inside surface of the panel or a thickness of an electron beam pass-through hole in a shadow mask at the panel edge is less than 115% of a corresponding thickness at the panel center.

13. A CRT, comprising:

a display panel comprising a substantially flat outer surface and an inner surface with a substantially fixed curvature, wherein the display panel exhibits a first transmissivity that varies as a function of position on the display panel;

a film coating on said outer surface with a second transmissivity that vanes as a function of position on the film coating, and as a function of said first transmissivity, wherein a said first transmissivity and said second transmissivity at any position between a display panel center and a display panel edge is within approximately 1.6% of a sum of said first transmissivity and said second transmissivity at any other position between said display panel center and said display panel edge.

14. The CRT of claim 13 wherein said film coating is further configured to reduce glare from said outer surface, to reduce reflections from said outer surface or to reduce static electricity build-up on said outer surface.

15. A coating for an image displaying CRT, comprising:

a film configured to reduce a variation in image brightness caused by a variation in a transmissivity of said CRT, wherein a sum of a transmissivity of said film and a transmissivity of said CRT at all positions on said CRT varies by no more than approximately 1.6%.

16. The coating of claim 15, further configured to reduce glare from said CRT.

17. The coating of claim 15, wherein amid film is further configured to be an antireflection coating on said CRT.

18. The coating of claim 15, wherein said film is further configured to reduce static electricity build-up on said CRT.

* * * * *